United States Patent [19]

Gierse

[11] 4,142,277

[45] Mar. 6, 1979

[54] CORDUROY CUTTING MACHINE

[75] Inventor: Franz-Josef Gierse, Siegen, Fed. Rep. of Germany

[73] Assignee: Franz Müller, Mönchen-Gladbach, Fed. Rep. of Germany

[21] Appl. No.: 807,297

[22] Filed: Jun. 16, 1977

[30] Foreign Application Priority Data

Jun. 16, 1976 [DE] Fed. Rep. of Germany ..... 2626869

[51] Int. Cl.[2] ..... D06C 13/08

[52] U.S. Cl. ..... 26/9

[58] Field of Search ..... 26/8 R, 8 C, 9, 15 R, 26/15 FB, 87

[56] References Cited

U.S. PATENT DOCUMENTS

| | | | |
|---|---|---|---|
| 1,681,917 | 8/1928 | Horstmann | 26/15 R |
| 2,486,121 | 10/1949 | Corn | 26/87 X |

FOREIGN PATENT DOCUMENTS

| | | | |
|---|---|---|---|
| 475971 | 4/1915 | France | 26/9 |
| 352 of | 1852 | United Kingdom | 26/9 |

*Primary Examiner*—Robert Mackey

*Attorney, Agent, or Firm*—Herbert L. Lerner

[57] ABSTRACT

Corduroy cutting machine having a knife shaft whereon a plurality of circular knives are mounted adjacent one another, and a table cooperating with the knife shaft and having a table edge over which, during operation of the machine, fabric formed with loops that are to be cut open by the circular knives is drawn, the improvement therein includes means at the table for adjusting and resetting the edge line of the table to a bending of the knife shaft that is dependent upon the operating condition of the machine.

2 Claims, 4 Drawing Figures

CORDUROY CUTTING MACHINE

The invention relates to a corduroy cutting machine having a knife shaft whereon a plurality of circular knives are mounted adjacent one another, and a table cooperating with the knife shaft and having a table edge over which, during operation of the machine, fabric formed with loops that are to be cut open by the circular knives is drawn.

Corduroy cutting machines serve for producing filling pile fabric and actual rib velvet. In the case of filling pile fabric, the pile is obtained by means of a special weft, the right-sided floats of which are cut open in the corduroy cutting machine. The latter occurs during an operation wherein the fabric, subjected to tension in the warp direction, is drawn over a table, the floating wefts forming "tubes." Each "tube" runs onto a needle having a longitudinal slot into which one of the circular knives mounted on the knife shaft partially dips. The gap between the edge of the table and the periphery of the circular knives must apparently be so large actually that the floating weft threads of the web traveling through the machine is severed while the backing remains undamaged, however.

From the foregoing, it is apparent that the gap between the periphery of the circular knives and the table edge must be of the same size along the entire width of the machine. In this regard, depending upon the type of fabric, tolerances of at most 0.05 to 0.1 mm are permissible. The spacing between the cutting blades of the circular knives and the table edge is determined by a number of constant influences and several variable components dependent upon the type of fabric, the velocity of the fabric and the rotary speed of the knife shaft. The constant components are capable of being controlled with the aid of manufacturing or production methods, such as touching up or conforming the table edge in accordance with the bent straight edge, trestle or the like in a manner that, for specific predetermined types of fabric, velocities of the fabric and rotary speeds of the knife shaft, the aforementioned spacing along the entire width of the machine is of equal size.

Since a corduroy cutting machine, during normal operation, is switched off and on again very often, however, frequently also after relatively few seconds of operating time, the variations in the spacing between the knife shaft and the table edge caused by the cutting forces must also be taken into account. These influences which are dependent upon the type of fabric, the velocity of the fabric and the rotary speed of the knife shaft and which increase sharply with increasing velocity of the fabric and rotary speed of the knife shaft have heretofore been controllable only to such a slight extent that conventional corduroy cutting machines have been able to operate only with a fabric travel velocity of about ten to fifteen meters per minute. As a reaction to the cutting force, the knife shaft namely would bend all the more, the greater the number of individual threads per unit time that is to be cut. Upon an increase in the fabric velocity and with the then simultaneously required increase in the rotary speed of the knife shaft, the knife shaft would bend all the more, relatively to the table edge that is capable of being made as stable or sturdy as desired, the greater the velocity of the fabric. With a corduroy cutting machine having, at standstill, an overall equally wide gap between the cutting blades of the circular knives and the edge of the table, the middle region of the gap becomes increasingly wider with increasing fabric velocity in a manner that the floating weft threads in this middle region finally are not being completely cut or are not being cut at all. On the other hand, if the machine is so constructed that the gap has the same width over-all at the desired high fabric velocity and high rotary speed of the knife shaft, then the backing would be damaged or cut in the middle region of the fabric width during start-up and braking of the machine.

Theoretically, this difficulty could be met by strengthening or reinforcing the knife shaft. This would mean, however, that heretofore employed circular knives would no longer be able to be slideable onto this shaft. The costly circular knives existing in very great numbers in the possession of the pertinent users would thereby become worthless. Furthermore, the geometrical relationships at the cutting station required for the cutting technology would be changed in an undue manner by the greater knife diameter (due to the greater shaft diameter). To reduce a bending of the knife shaft, the latter, could also be clamped at both ends thereof, respectively, into two bearings. These double bearings, which must be disposed relatively close to one another at each end of the knife shaft if the machine is not to become too wide, are operationally reliable only if they have a very sturdy construction, because of the mutual reaction.

If the number of bearings is doubled, however, and more sturdy bearings than heretofore are simultaneously required, the machine becomes too costly. In addition, larger bearings naturally have greater play so that what is gained by a slighter bending is partly compensated or lost by the greater play.

It is accordingly an object of the invention to find a way out of the foregoing group of problems by providing a corduroy cutting machine, in accordance with the invention, which, even at high fabric velocities of 25 meters per minute and more, for example, and corresponding rotary speeds of the knife shaft, has a gap of the same size between the periphery of the circular knives and the edge of the table over the entire width of the machine for all speeds between standstill and maximal speed. In spite of the variable bending of the knife shaft as reaction to the cutting force, it is another object of the invention to provide such a machine as will attain a trouble-free cutting configuration. It is a further object of the invention to provide a corduroy cutting machine of the foregoing type which can especially be employed for all qualities of material that may come into question. In this regard, it should be taken into consideration that a very tightly woven fabric or a fabric having a high rib count exerts a greater bending force on the knife shaft than does a lighter material with fewer ribs for the same fabric velocity and rotary speed of the knife shaft.

With the foregoing and other objects in view, there is provided, in accordance with the invention, a corduroy cutting machine having a knife shaft whereon a plurality of circular knives are mounted adjacent one another, and a table cooperating with the knife shaft and having a table edge over which, during operation of the machine, fabric formed with loops that are to be cut open by the circular knives is drawn, the improvement therein comprising means at the table for adjusting and resetting the edge line of the table to a bending of the knife shaft that is dependent upon the operating condition of the machine.

In accordance with another feature of the invention, the foregoing means also include means for adjusting and resetting the edge line of the table to a bending of the knife shaft that is dependent upon the quality and speed of the fabric to be cut as well as upon the rotary speed of the knife shaft.

In accordance with an added feature of the invention, the first-mentioned means are at least partly automatically operative.

In accordance with a concomitant feature of the invention, the latter means comprise an adjustable trestle associated with the table.

What is attained by the invention is that, in contrast to conventional construction and mounting of the knife shaft and the bending thereof which is variable in accordance with the operating condition and the loading, the gap between the cutting blades of the circular knives and the edge of the table remains the same over the entire width of the machine and is controllable to a predetermined gap width. This result is achieved by not making the table arbitrarily rigid but rather, for example, by associating a trestle therewith having a clamping bolt or tension rod with a controllably variable length so that the shape of the edge of the table is adjustable to the bending line of the knife shaft which changes in accordance with the varying operating conditions and loadings and is resettable in accordance with the changed bending line. The clamping bolt or tension rod of the trestle can be made adjustable, for example, by an adjusting nut driven by a servomotor (such as a step motor, for example) or by means of an eccentric which is driven hydraulically or by an electric motor.

The adjustment or accommodation of the shape of the edge to the bend of the knife shaft is able to be automated if the bend in the shaft is determined and the adjusting drive of the trestle is controlled in accordance with the measured value of the bend in the shaft. Generally, it is sufficient, however, to determine the bends of the knife shaft produced during given operating conditions and loadings of the knife shaft, and accordingly to program the adjusting drive of the trestle associated with the table. When the corduroy cutting machine is switched on, the table edge is then formed or shaped, in accordance with the bend of the knife shaft that is produced, to such an extent wherein the bend is developed with increasing rotary speed of the shaft and travel velocity of the fabric. When the machine is switched off, which occurs almost instantaneously in corduroy cutting machines, it is generally sufficient to retract the table bend as rapidly as the knife shaft is braked. This can be effected by switching off the shut-off contact of the knife shaft together with the resetting mechanism of the trestle in such a manner that the knife shaft is braked and the tension rod or clamping bolt of the trestle is released or cleared by means of a single push of a button.

Other features which are considered as characteristic for the invention are set forth in the appended claims.

Although the invention is illustrated and described herein as embodied in a corduroy cuttng machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
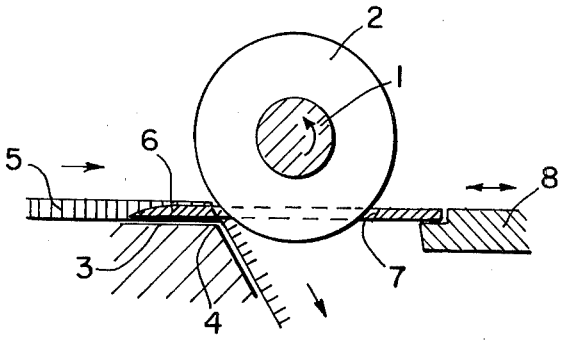
FIG. 1 is a fragmentary elevational view of a corduroy cutting machine showing the mutual association of table and knife shaft in accordance with the invention.

Referring now to the drawing, and first, particularly, to FIG. 1 thereof, there is shown a partial view of a corduroy cutting machine as seen in direction of the longitudinal axis of the knife shaft 1 thereof. Circular knives 2 (only one of which is shown in FIG. 1) are mounted on the knife shaft 1. The knife shaft 1 is rotatable in the direction of the curved arrow shown on the shaft 1 in FIG. 1. Disposed opposite the knife shaft 1 is a table 3 having a table edge 4. A fabric web 5 that is to be cut or that is cut travels over the table 3 in the direction of the arrow shown at the left-hand side of FIG. 1. Just before the fabric web 5 reaches the table edge 4, respective "tubes" formed by floating wefts of the fabric web run up onto a point of a needle 6. The needle 6 has a longitudinal slot 7 formed in a middle region thereof, a circular knife 2 dipping partially into the longitudinal slot 7. The needle 6 is held at the rear end thereof in a beam 8 or in individual push-rods, which are reciprocated in the direction of the double-headed arrow associated therewith in FIG. 1 so that the needle can be accommodated to the movement of the fabric web 5.

Figure 2:
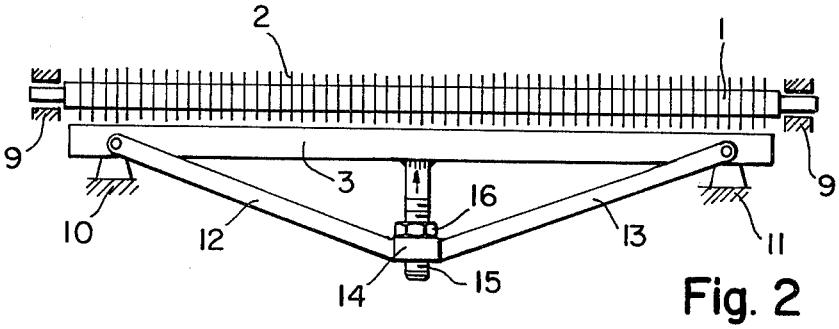
FIG. 2 is a view, in reduced size, of the table with a strut frame or trestle and the knife shaft as seen from the left hand side of FIG. 1.

FIG. 2 shows the table 3 as viewed perpendicularly to the longitudinal axis of the knife shaft 1. It is also apparent from FIG. 2 how the circular knives 2 are disposed adjacent one another on the knife shaft 1. The knife shaft 1 is shown diagrammatically or symbolically mounted in bearings 9. The table 3 according to FIG. 2 is formed, in principle, as a support member freely disposed on points 10 and 11. A support bracket or yoke or tie rods 12 and 13 are fastened, for example, with the aid of screws to respective portions of the table 3. The tie rods 12 and 13 are connected in the middle beneath the table 3 by a perforated disc 14. A threaded bolt 15 representing the clamping stud or tensioning bar or the set screw or thumb screw of the strut frame or trestle extends through the perforated disc 14. An adjusting nut 16 is threadedly received on the threaded bolt 15 above the perforated disc 14. By tightening the adjusting nut 16, the threaded bolt 15 is displaceable in the direction of the arrow shown thereon in FIG. 2, in a manner that the table 3 is bent upwardly i.e. in the direction toward the knife shaft 1 or the circular knives 2.

Figure 3:
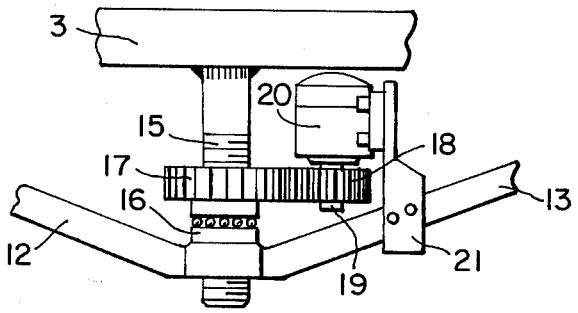
FIGS. 3 and 4 are fragmentary enlarged views of FIG. 2 showing two different embodiments, respectively, of adjusting drives for the strut frame.

FIG. 3 shows, in principle, means for mechanically actuating the adjusting screw 16 according to FIG. 2. The adjusting screw 16 is thus rigidly connected to a ring gear 17 which meshes with a gear 18. The gear 18 is firmly connected to the drive shaft 19 of a servomotor, such as a step motor 20, for example. The step motor 20, as shown in FIG. 3, can be secured by means of a bracket 21 to the tie rod 13.

Figure 4:
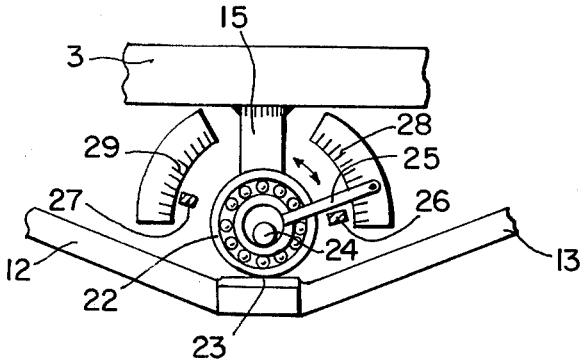

To vary the pretensioning of the strut frame or trestle, an eccentric disc 22 according to FIG. 4 can also be used. The threaded clamping stud 15 of the strut frame or trestle, in the embodiment of FIG. 4, does not rest directly on the connection of the tie rods 12 and 13 but rather through the intermediary of the eccentric disc 22 and a plate 23. The eccentric disc 22 is mounted by means of a shaft 24 on the clamping stud 15 and is turnable by means of a lever 25 in the directions of the double-headed arrow in FIG. 4 so that pretensioning of the strut frame or trestle is adjustable in a desired manner. Adjustment of the eccentric disc 22 can be effected in any conventional manner, for example, by means of a compressed air cylinder, an electromagnet or a servomotor acting upon the shaft 24 (direct drive or drive through an intermediate transmission system).

Since the start-up and braking of the knife shaft 1 according to FIG. 1 in corduroy cutting machines occurs exceptionally rapidly, it is essential that the adjustment of the clamping stud 15 of the strut frame or trestle should also occur equally rapidly. In order to attain, for example, with the eccentric of FIG. 4, the setting thereof associated with the stoppage of the knife shaft 1 and the adjustment thereof corresponding to the assigned maximal speed of the knife shaft 1 without delay, yet also not exceed those values, it can be advantageous, in accordance with the invention, to provide, for example, adjustable stops 26 and 27 at the end positions of the lever 25 of the eccentric disc 22 and also to provide scales 28 and 29 in association with those stops 26 and 27, the latter being shiftable in accordance with the respective extreme operating conditions i.e. stoppage and maximal speed, along the scales 28 and 29.

The embodiments described hereinbefore have been employed solely for explaining the operation of the strut frame or trestle of the invention. Obviously, the adjusting means can be actuated directly from the control panel of the machine or be actuated automatically by the machine in actual practice.

I claim:

1. Corduroy cutting machine having a knife shaft whereon a plurality of circular knives are mounted adjacent one another, and a table cooperating with the knife shaft and having a table edge over which, during operation of the machine, fabric formed with loops that are to be cut open by the circular knives is drawn, the improvement therein comprising means at the table for adjusting and resetting the edge line of the table to a bending of the knife shaft that is dependent upon the operating condition of the machine, said means comprising an adjustable trestle associated with the table.

2. Corduroy cutting machine according to claim 1 wherein said trestle is formed of a pair of arms connected at one end, respectively, thereof and extending transversely to said table, and including means for applying stress to the other ends, respectively, of said pair of arms in directions toward the edge line of the table.

* * * * *